US008328315B2

(12) United States Patent
Eun et al.

(10) Patent No.: US 8,328,315 B2
(45) Date of Patent: Dec. 11, 2012

(54) SYSTEM AND METHOD FOR SWITCHING REGISTRATION CONTROL MODES IN A CONTINUOUS FEED PRINTER

(75) Inventors: Yongsoon Eun, Webster, NY (US); Jess R. Gentner, Rochester, NY (US); R. Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 244 days.

(21) Appl. No.: 12/761,528

(22) Filed: Apr. 16, 2010

(65) Prior Publication Data

US 2011/0255911 A1 Oct. 20, 2011

(51) Int. Cl.
*B41J 29/38* (2006.01)

(52) U.S. Cl. ..... 347/14; 347/5; 347/9

(58) Field of Classification Search ..... 347/5, 9, 347/16, 14
See application file for complete search history.

(56) References Cited

U.S. PATENT DOCUMENTS

| | | | |
|---|---|---|---|
| 7,665,817 | B2 | 2/2010 | Folkins |
| 2008/0124158 | A1 | 5/2008 | Folkins |
| 2010/0046014 | A1 | 2/2010 | Eun et al. |

*Primary Examiner* — Lam S Nguyen

(74) *Attorney, Agent, or Firm* — Maginot, Moore & Beck, LLP

(57) ABSTRACT

A method enables a printing system to be operated in one of two registration control modes. The method includes operating at least one marking station with reference to a first velocity measurement of a web moving along a web path in response to a first registration control mode being active, the first velocity measurement corresponding to an angular velocity signal obtained from only a first roller in a web path, and operating the at least one marking station with reference to a second velocity measurement of the web moving along the web path in response to a second registration control mode being active, the second velocity measurement corresponding to at least two angular velocity signals obtained from at least the first roller and a second roller in the web path.

7 Claims, 5 Drawing Sheets

SYSTEM AND METHOD FOR SWITCHING REGISTRATION CONTROL MODES IN A CONTINUOUS FEED PRINTER

TECHNICAL FIELD

The system and method described below relate generally to moving web printing systems, and more particularly, to moving web printing systems that use a reflex system to register images produced from different marking stations in the system.

BACKGROUND

A known system for ejecting ink to form images on a moving web of media material is shown in FIG. 5. The system 10 includes a web unwinding unit 14, a printing system 18, and a cutting station 22. In brief, the web unwinding unit 14 includes an actuator, such as an electrical motor, that rotates a roll of media material in a direction that removes a web 26 of media material from the unwinding unit 14. The web 26 is fed through the printing system 18 along a path, which extends to the cutting station 22. The printing system 18 treats the web 26 to remove debris and loose particulate matter from the web surface, ejects ink with numerous marking stations onto the moving web to form printed images, and then fixes the printed image to the web. The marking stations may eject different colored inks onto the web 26 to form a composite colored image. In one system, the marking stations eject cyan, magenta, yellow, and black ink for forming composite colored images. The web 26 is then pulled into the cutting station 22, which cuts the web into sheets for further processing.

The printing system 18 uses a registration control method to control the timing of the ink ejections onto the web 26 as the web passes the marking stations. One known registration control method that may be used to operate the marking stations in the printing system 18 is the single reflex method. In the single reflex method, the rotation of a single roller at or near a marking station is monitored by an encoder. The encoder may be a mechanical or electronic device that measures the angular velocity of the roller and generates a signal corresponding to the angular velocity of the roller. The angular velocity signal is processed by a controller executing programmed instructions for implementing the single reflex method to calculate the linear velocity of the web. The controller may adjust the linear web velocity calculation by using tension measurement signals generated by one or more load cells that measure the tension on the web 26 near the roller. The controller implementing the single reflex method is configured with input/output circuitry, memory, programmed instructions, and other electronic components to calculate the linear web velocity and to generate the firing signals for the printheads in the marking stations.

Another known registration control method that may be used to operate the marking stations in the printing system 18 is the double reflex method. In the double reflex method, two rollers are each monitored by an encoder. One roller lies on the web path before the marking stations and the other roller lies on the web path following the marking stations. The angular velocity signals generated by the encoders for the two rollers are processed by a controller executing programmed instructions for implementing the double reflex method to calculate the linear velocity of the web 26 at each roller and then to interpolate the linear velocity of the web at each of the marking stations. These additional calculations enable better timing of the firing signals for the printheads in the marking stations and, consequently, improved registration of the images printed by the marking stations in the printing system 18.

While the double reflex registration method enables more accurate timing of firing signals for better image registration, the method suffers from inaccuracies during transitions in web 26 velocity. These inaccuracies may arise from induced transients in low pass and high pass filters, which are used to equalize the angular velocity signals generated by the encoders. These transients occur as the web 26 accelerates to reach a steady state operational speed and as the web decelerates to a stop. Addressing the web velocity inaccuracies during web acceleration and deceleration would be useful.

SUMMARY

A method of performing registration control in a printing system enables accurate web velocity calculations during operational steady state speeds for the printing system and during web velocity transitional periods. The method includes operating a plurality of marking stations with reference to a first velocity measurement of a web moving along a web path in response to a first registration control mode being active, the first velocity measurement corresponding to an angular velocity signal obtained from only a first roller in a web path, and operating the plurality of marking stations with reference to a second velocity measurement of the web moving along the web path in response to a second registration control mode being active, the second velocity measurement corresponding to at least two angular velocity signals obtained from at least the first roller and a second roller in the web path.

A system for implementing the registration control method has been developed. The system includes at least one marking station arranged along a portion of a web path, a first roller in the web path, the first roller being configured to move a web of media along the portion of the web path along which the at least one marking station is arranged, a second roller in the web path, the second roller being configured to move the web of media along the portion of the web path along which the at least one marking station is arranged, a first encoder mounted proximate the first roller and configured to generate an angular velocity signal corresponding to rotation of the first roller, a second encoder mounted proximate the second roller and configured to generate an angular velocity signal corresponding to rotation of the second roller, a first converter operatively connected to the first encoder and configured to generate a first linear velocity signal corresponding to a velocity for a web moving along the web path at the first roller, a second converter operatively connected to the second encoder and configured to generate a second linear velocity signal corresponding to a velocity for a web moving along the web path at the second roller, and a controller operatively connected to the at least one marking station, the first converter, and the second converter and being configured to operate the at least one marking station with reference to a registration control mode, the controller being configured to compute a linear velocity for the web with reference to the linear velocity signal generated by only one of the first converter and the second converter in response to a first registration control mode being active and to compute the linear velocity of the web with reference to the generated linear velocity signals generated by both the first converter and the second converter in response to a second registration control mode being active.

BRIEF DESCRIPTION OF THE DRAWINGS

The foregoing aspects and other features of a system and method that enables accurate linear web velocity measurements during steady state web speed periods and transitional web speed periods are explained in the following description, taken in connection with the accompanying drawings.

DETAILED DESCRIPTION

Figure 1:
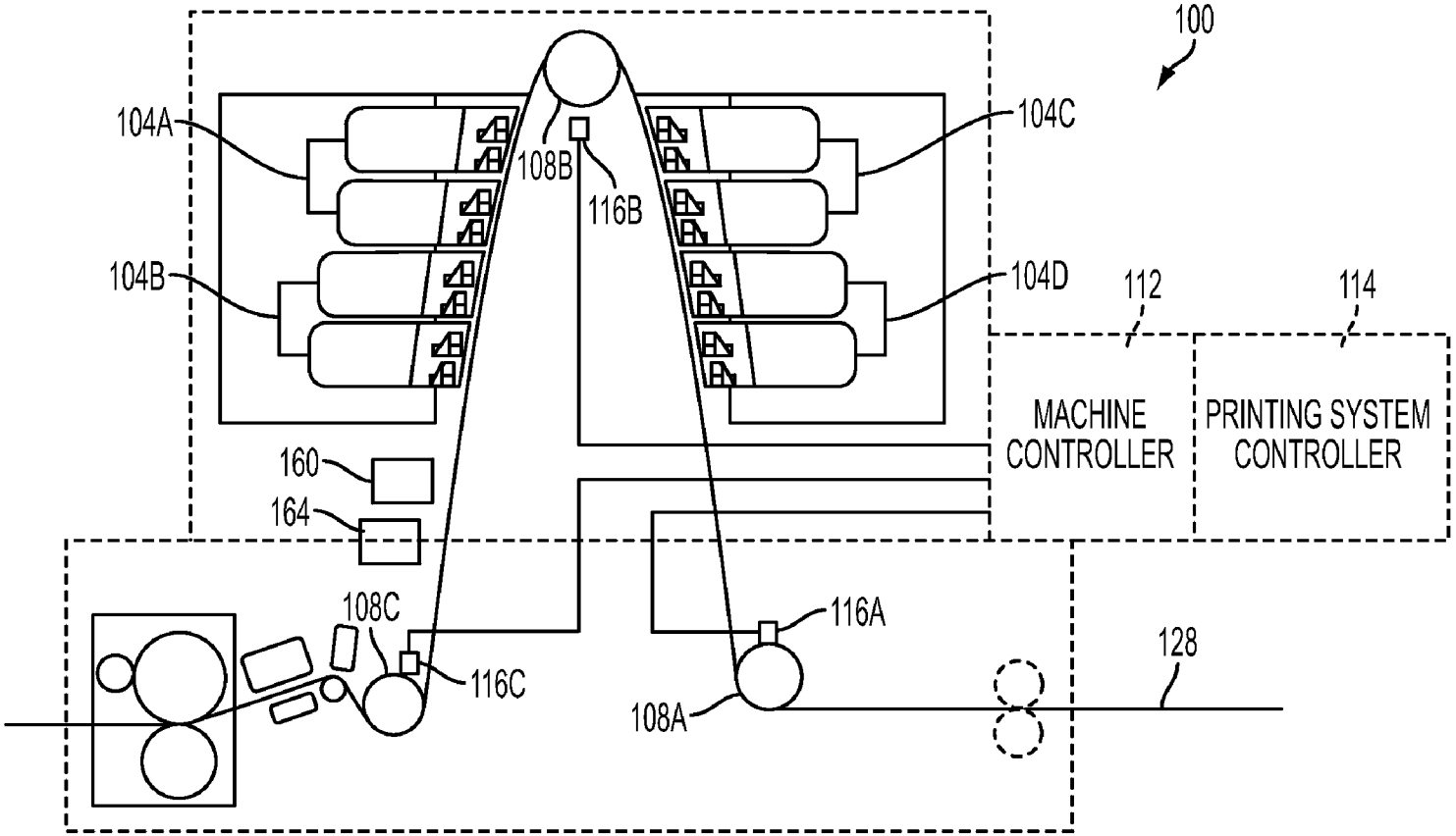
FIG. 1 is a block diagram of a printing system configured to print images on a continuous web of print media and to implement a double reflex registration method and a single reflex registration method selectively.

Reference is made to the drawings for a general understanding of the environment and details for the system and method disclosed herein. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like.

As shown in FIG. 1, a continuous feed printing system 100 prints images on a continuous web of print media. The printing system 100 utilizes either a single reflex registration method/mode or a double reflex registration method/mode, depending on the velocity of the continuous web through the printing system. The printing system 100 may use the double reflex registration method when the continuous web is moving at a constant velocity (zero acceleration), and the printing system may use the single reflex registration method when the continuous web is accelerating (positive acceleration) or decelerating (negative acceleration).

The printing system 100 of FIG. 1 includes marking stations 104A, 104B, 104C, 104D; rollers 108A, 108B, 108C; a machine controller 112; a printing system controller 114; encoders 116A, 116B, 116C; an ink leveling device 160; and an ink curing device 164. The marking stations 104A, 104B, 104C, 104D are mechanically connected to a printer frame and electronically connected to the machine controller 112. The marking stations 104A, 104B, 104C, 104D are configured to eject droplets of liquid ink onto a continuous web 128 of print media in response to receiving firing signals from the controller 112. The rollers 108A, 108B, 108C, which are rotatably connected to the printer frame, guide the continuous web 128 through the printing system 100 along a web path. A print zone extends from the roller 108A to the roller 108B and from the roller 108B to the roller 108C. The encoders 116A, 116B, 116C generate an angular velocity signal corresponding to an angular velocity of a respective one of the rollers 108A, 108B, 108C. Each encoder 116A, 116B, 116C may be a mechanical or electronic device as known to those of ordinary skill in the art. An electrical output of each encoder 116A, 116B, 116C is processed by a converter 120A, 120B, 120C (FIG. 2), which converts a respective one of the angular velocity signals to a linear velocity signal. The printing system controller 114 is configured to receive and/or generate image printing scheduling data, among other functions, and is electrically connected to at least the machine controller 112. The machine controller 112 computes a linear velocity at each point of the continuous web 128 proximate to a marking station 104 using either the single or double reflex registration method. The ink leveling device 160 and the ink curing device 164 are connected to the printer frame subsequent to the marking stations to prepare certain inks for distribution.

The rollers 108A, 108B, 108C are configured to guide the continuous web 128 through the printing system 100 on the web path. The rollers 108A, 108B, 108C may be any type of roller configured to guide the continuous web 128, as known to those of ordinary skill in the art. As shown in FIG. 1, the roller 108A is positioned before the marking stations 104C, 104D in the direction of web motion and the roller 108B is positioned after the marking stations 104C, 104D in the direction of web motion. Similarly, the roller 108B is positioned before the marking stations 104A, 104B in the direction of web motion and the roller 108C is positioned after the marking stations 104A, 104B in the direction of web motion.

The marking stations 104A, 104B, 104C, 104D, sometimes referred to as printhead arrays or inkjet arrays, include an ink reservoir, inkjet ejectors, and nozzles as known to those of ordinary skill in the art, but not illustrated in FIG. 1. The nozzles, which may have a diameter of approximately twenty micrometers (20 μm) to thirty micrometers (30 μm), are fluidly connected to an ink reservoir to receive liquid ink from the ink reservoir. The inkjet ejectors receive firing signals from the controller 112 in a known manner and, in response, eject ink droplets onto the continuous web 128. The inkjet ejectors may be may be thermal inkjet ejectors, piezoelectric inkjet ejectors, or any other inkjet ejector known to those of ordinary skill in the art. Although the marking stations 104A, 104B, 104C, 104D shown are in the form of sets of inkjet arrays, each marking station corresponds to one primary color or other type of marking material; however, other types of marking stations and arrangements are possible, such as each marking station being capable of printing multiples colors or types and/or one or more marking stations utilizing electrophotography or ionography.

Figure 2:
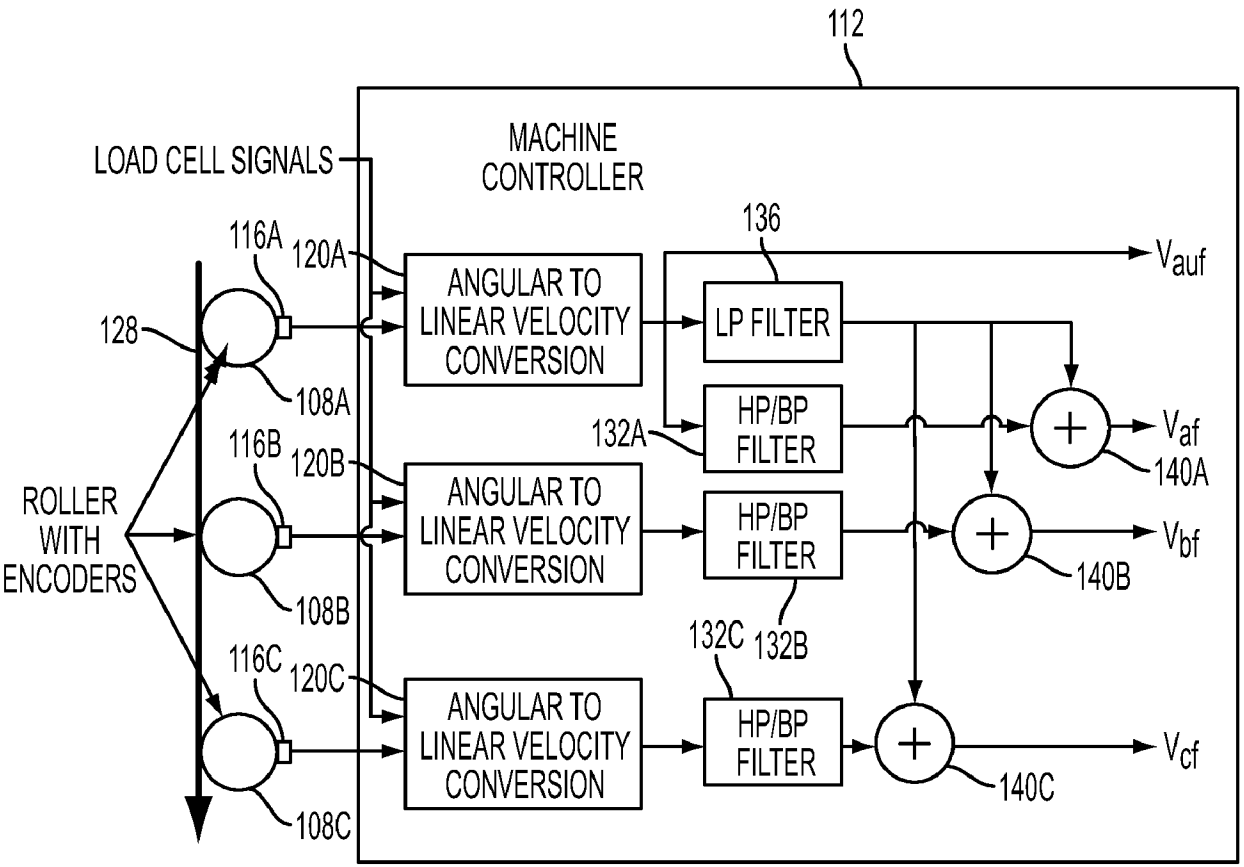
FIG. 2 is a block diagram of a portion of the printing system of FIG. 1, illustrating software components within a machine controller.

As shown in FIG. 2, the machine controller 112 includes filters 132A, 132B, 132C, 136 and adders 140A, 140B, 140C, which are coupled to converters 120A, 120B, 120C. The converters 120A, 120B, 120C may be stand-alone processors, ASICs, or hardware/software circuits that convert an angular velocity signal to a linear web velocity. In general, the converters 120A, 120B, 120C generate the linear velocity signal with reference to the circumference of the rollers 108A, 108B, 108C and the number of pulses produced by the encoders 116A, 116B, 116C per revolution of the rollers. Additionally, each of the converters 120A, 120B, 120C may receive load cell signals (FIG. 2) from a respective load cell configured to generate an electronic signal that corresponds to tension on the web 128 at various positions. These tension measurements and other data, such as the mass of the web 128 per unit of length of the web 128, may be used to adjust the linear velocities generated by the converters 120A, 120B, 120C. These adjustments to the linear velocity may be made prior or subsequent to the filtering of the linear velocities described below.

Each of the converters 120A, 120B, 120C is coupled, respectively, to a corresponding high pass filter 132A, 132B, 132C. The converter 120A, which is associated with the roller 108A and the encoder 116A, is also coupled to a low pass filter 136. The outputs of the filters 132A, 132B, 132C, 136 are received by the adders 140A, 140B, 140C. The high pass filters 132A, 132B, 132C enable only the relatively rapid changes in linear velocity to pass through. In one embodiment, the high pass filters 132A, 132B, 132C have a cutoff frequency of approximately 0.1 Hz. The cutoff frequency for any filter discussed in this document may be adjusted to accommodate the system parameters, such as web length, average speed, media density, and the like. The high pass filters 132A, 132B, 132C, in effect, remove the average velocity component of the output signals of the encoders 116A, 116B, 116C. The low pass filter 136 is coupled to the output of the converter 120A to receive the linear velocity measured by the converter 120A. The cutoff frequency for the low pass filter 136 is also approximately 0.1 Hz, such that the output of the filter is a relatively slow changing signal, which corresponds to the average linear velocity of the web 128 at the roller 108A. The output of the low pass filter 136 corresponds to the average linear velocity of the web 128 throughout the print zone, which does not change at the rollers 108B, 108C; otherwise, the web 128 would break or go slack.

With reference still to FIG. 2, the adders 140A, 140B, 140C sum the low pass filtered signal for the roller 108A with the high pass filtered signal for a corresponding one of the rollers 108A, 108B, 108C. Specifically, the adder 140A adds the low pass filtered signal from the filter 136 and the high pass filtered signal from filter 132A, such that the composite output signal $v_{af}$ of the adder 140A corresponds approximately to an unfiltered linear velocity output $v_{auf}$ of the first converter 120A, except for the possibility of transient responses introduced to the signal $v_{af}$ by the filters 132A, 136. The adder 140B adds the low pass filtered signal for the filter 136 corresponding to the roller 108A to the high pass filtered signal from the filter 132B corresponding to the roller 108B. The composite output $v_{bf}$ of the adder 140B represents the average linear velocity of the web 128 combined with the high frequency variations in the linear web velocity at the roller 108B. The adder 140C adds the low pass filtered signal from the filter 136 corresponding to the roller 108A to the high pass filtered signal from the filter 132C corresponding to the roller 108C. The output $v_{cf}$ of the adder 140C is a composite signal that represents the average linear velocity of the web 128 combined with the high frequency variations in the linear web velocity at the roller 108C. By using these composite signals $v_{af}$, $v_{bf}$, $v_{cf}$, the controller 112 avoids web velocity calculation errors associated with linear velocity variations occurring at each roller 108A, 108B, 108C, because each composite velocity signal is equalized to the low frequency component of the linear web velocity at a single roller, such as the roller 108A. This common baseline for the linear web velocities at each roller 108A, 108B, 108C improves the accuracy of the web velocity calculation at each roller. Consequently, the interpolated web velocities computed by the controller 112 for each marking station 104A, 104B, 104C, 104D are calculated with greater accuracy and misregistration occurs less frequently.

The controller 112 uses the composite signals outputs $v_{af}$, $v_{bf}$, $v_{cf}$ from the adders 140A, 140B, 140C and/or the output $v_{auf}$ from the converter 120A, to compute and/or interpolate the web velocities at the rollers 108A, 108B, 108C and the marking stations 104A, 104B, 104C, 104D. The controller 112 includes electronic memory to store data and programmed instructions, which may be executed with general or specialized programmable processors. The programmed instructions, memories, and interface circuitry configure the controller 112 to perform the functions for computing the velocity of the web 128 at various locations and to generate firing signals in relation with those computed velocities. The components of the controller 112 may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Figure 3:
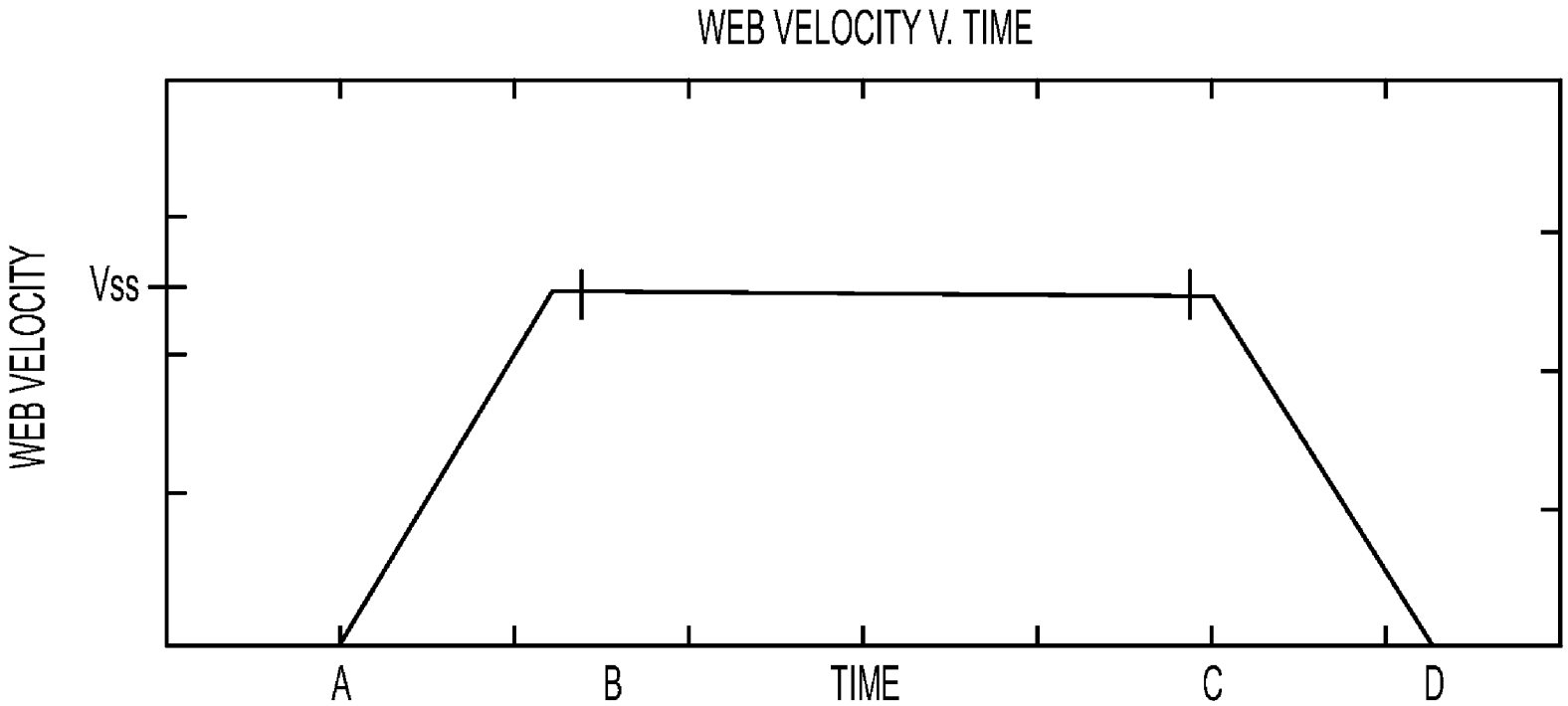
FIG. 3 is a graph of web velocity versus time.

As shown in the graph of velocity versus time of FIG. 3, the continuous web 128 moves through the printing system 100 with a variable velocity. The time period between the point A and the point B illustrates the increasing velocity of the continuous web 128 as the continuous web is accelerated from zero velocity, or a low velocity, to an approximately constant velocity or steady state velocity ("Vss"). For example, the velocity of the continuous web 128 increases from zero upon initiating a print job. The time period between the point B and the point C illustrates the steady state velocity Vss of the continuous web 128. For example, printing system 100 may maintain the continuous web 128 at the steady state velocity Vss until the conclusion of the print job nears. The time period between the point C and the point D illustrates the decreasing velocity of the continuous web 128 as the continuous web is decelerated from the steady state velocity Vss to zero velocity or a low velocity. For example, the continuous web 128 may decelerate (exhibit a negative acceleration) at the conclusion of a print job. The time period of FIG. 3 is not illustrated to scale. In general, the time period between the points B and C is much greater than the time period between the points A and B and the points C and D.

At the steady state velocity Vss, the average web velocity multiplied by the web material mass per length must be equal at all rollers 108A, 108B, 108C and other non-slip web interface surfaces; otherwise, the web 128 would either break or go slack. To account for the differences in instantaneous velocities at the rollers 108A, 108B, 108C in or near the print zone, the controller 112 may implement a double reflex registration process to interpolate the linear web velocity at points between a given pair of the rollers, with one roller of the pair of the rollers on each side of a marking station 104A, 104B, 104C, 104D, to identify the linear velocity for the web at positions proximate the marking stations. To interpolate the linear web velocity at a particular one of the marking stations 104A, 104B, 104C, 104D the controller 112 implementing the double reflex registration process uses (i) the linear web velocity derived from the angular velocity of one of the rollers 108A, 108B, 108C placed at a position before the web 128 passes the marking station, (ii) the linear web velocity derived from the angular velocity of one of the rollers placed at a position after the web passes the marking station, and (iii) the relative distances between the marking station and the two rollers. The interpolated value correlates to a linear web velocity at the particular marking station 104A, 104B, 104C, 104D. A linear web velocity is interpolated for each marking station 104A, 104B, 104C, 104D to enable the controller 112 to generate the firing signals for the printheads in each marking station to eject ink as the appropriate portion of the web 128 travels past each marking station.

Any differences arising between the measured linear velocities for the web 128 at each of the rollers 108A, 108B, 108C arises from inaccuracies that may lead to errors in the interpolation of the linear web velocity at the marking stations 104A, 104B, 104C, 104D. These errors may lead to misregistration between ink patterns ejected by different marking stations 104A, 104B, 104C, 104D. In the double reflex control method, these errors may affect the velocity calculated at each marking station 104A, 104B, 104C, 104D differently because of the different distances separating them. Calibrating the encoders 116A, 116B, 116C that generate the angular velocity signals is generally insufficient to address the variations in the linear velocities because small errors may eventually accumulate and cause misregistration. For example, a roller diameter miscalculation of only 5 μm, which may be approximately a 0.002% error for one roller, would yield a continuously accumulating error of about 10 μm per meter of web travel. The circuit of FIG. 2 addresses this source of linear web velocity and position error.

The above-described base velocity approximation fails to produce accurate results when the continuous web 128 is accelerating or decelerating. Specifically, the filters 132A, 132B, 132C, and 136 (FIG. 2) may produce an output signal comprised of a steady-state response and a transient response. In response to an approximately constant input, which corresponds to an approximately constant web 128 velocity, the transient response may be zero or may converge to zero, such that the output of the filters 132A, 132B, 132C, 136 is effectively only the steady state response. In response, however, to an input having a rate of change, such as when the continuous web 128 exhibits a changing velocity, the transient response may be non-zero for a length of time significant enough to introduce errors to the linear velocity calculation. These, errors in the linear velocity signals may cause the controller 112 executing the double reflex registration method to generate firing signals that are not as well synchronized with the accelerating web 128 as they are when the velocity of the web is more stable. To address this source of error, the controller 112 computes the web velocity with the unfiltered linear velocity signal from one of the converters 120A, 120B, 120C. As shown in FIG. 2, the unfiltered linear velocity signal is the output $v_{auf}$ from the converter 120A. In general, the unfiltered linear velocity signal is generated by one of the converter 120A, 120B, 120C connected to the low pass filter 136.

The controller 112 of the printing system 100 implements selectively the single reflex registration method and the double reflex registration method. The controller 112 implements the double reflex registration method when the continuous web 128 is moving with an approximately constant velocity, such as when a magnitude of the web acceleration is below an acceleration threshold or when the web velocity is above a velocity threshold. The controller 112 implements the single reflex registration method when the continuous web 128 exhibits a changing velocity, such as when the magnitude of the web acceleration is above an acceleration threshold or when the web velocity is below a velocity threshold. As shown in the graph of FIG. 3, for example, the controller 112 implements the single reflex registration process between the points A and B and between the points C and D, and the controller implements the double reflex registration process between the points B and C. Accordingly, the controller 112 maximizes the accuracy of the velocity calculations by executing the registration method that produces the most accurate results based on the velocity of the continuous web 128. In one embodiment, when the controller 112 uses the double reflex registration method to control the firing of the printheads, the controller uses the composite velocity signals $v_{af}$, $v_{bf}$, $v_{cf}$. When the controller 112 uses the single reflex method to control the firing of the printheads, the controller may use the unfiltered linear velocity signal $v_{auf}$ from the converter 120A connected to the low pass filter 136.

The controller 112 may be configured to switch gradually between the single reflex and double reflex registration methods. For example, in one embodiment the controller 112 may include software that implements the following mathematical equations:

$$w_a=\lambda v_{af}+(1-\lambda)v_{auf}$$

$$w_b=\lambda v_{bf}+(1-\lambda)v_{auf}$$

$$w_c=\lambda v_{cf}+(1-\lambda)v_{auf}$$

The parameters $w_a$, $w_b$, $w_c$ denote the weighted sum velocity measurements for the continuous web 128 as a combination of the single reflex registration method velocity calculation and the double reflex registration method velocity calculation. The parameters $v_{af}$, $v_{bf}$, $v_{cf}$ denote the composite velocity signals from the adders 140A, 140B, 140C as used with the double reflex registration method. The parameter $v_{auf}$ denotes the unfiltered velocity from the converter 120A connected to the low pass filter 136, as used with the single reflex registration method. The controller 112 switches between single reflex method and double reflex method by gradually varying the parameter λ. In particular, the parameter λ, is a value ranging from 0 to 1, in which 0 indicates that the printing system 100 is operating in single reflex mode and 1 indicates that the system is operating in double reflex mode. When switching from the single reflex method to double reflex method the velocities represented by $v_{af}$, $v_{bf}$, $v_{cf}$ may be referred to as a velocity set point, because the controller 112 gradually switches from using the single reflex velocity $v_{auf}$ to the double reflex velocities $v_{af}$, $v_{bf}$, $v_{cf}$. Conversely, when switching from the double reflex method to the single reflex method the velocity represented by $v_{auf}$ may be referred to as a velocity set point, because the controller 112 gradually switches from using the double reflex velocities $v_{af}$, $v_{bf}$, $v_{af}$ to the single reflex velocity $v_{auf}$. The above-noted equations and the program configured to switch between single reflex method and double reflex method may be stored in memory as a program run by the controller 112 or may be implemented by a separate registration controller, which contains decision logic, an output of which is received by the controller 112.

The controller 112 may be triggered to switch between the single reflex and double reflex registration methods by one or more of numerous signals. In particular, the signal may be generated by a logic unit separate from the controller 112, which contains decision logic. The logic unit monitors the velocity of the continuous web 128 and determines which registration method should be used by the controller 112. For example, the logic unit may cause the controller 112 to use the single reflex method in response to detecting that the velocity of the continuous web 128 is below the steady state velocity Vss. Alternatively, controller 112 may include a memory programmed to execute a program, which compares the detected web velocity to a threshold velocity such as the Vss. The program causes the controller 112 to utilize the single reflex method when the detected velocity is below the threshold velocity. If the velocity of the web 128 is below the threshold velocity, then the continuous web is either accelerating to the threshold velocity or is decelerating to a zero velocity.

Additionally, or alternatively, the controller 112 may be triggered to switch between the single reflex and double reflex registration methods by monitoring the acceleration of the web 128. For example, software may be provided, which converts at least one of the velocity signals $v_{af}$, $v_{bf}$, $v_{cf}$, $v_{auf}$ into an acceleration using a currently detected velocity and at least one previously detected velocity. If a magnitude of the detected acceleration is below a threshold acceleration, indicating that the web 128 is moving at an approximately constant velocity, the controller 112 may use the double reflex registration method. If, however, the magnitude of the detected acceleration is above a threshold acceleration, indicating that the web 128 exhibiting a change in velocity, the controller 112 may use the single reflex registration method.

Additionally, or alternatively, the machine controller 112 may be triggered to switch between the single reflex and double reflex registration methods by receiving a signal from a high-level printing system controller 114 (FIG. 1), which performs image scheduling and coordinates web motion cut-off, among other tasks. Accordingly, in embodiments of the printing system 100 including the high-level controller 114, the machine controller 112 may not compare a velocity of the web 128 to a threshold velocity or threshold acceleration and, instead, may switch between the single reflex method and the double reflex method upon receiving one or more signals from the high-level controller 114.

Figure 4:
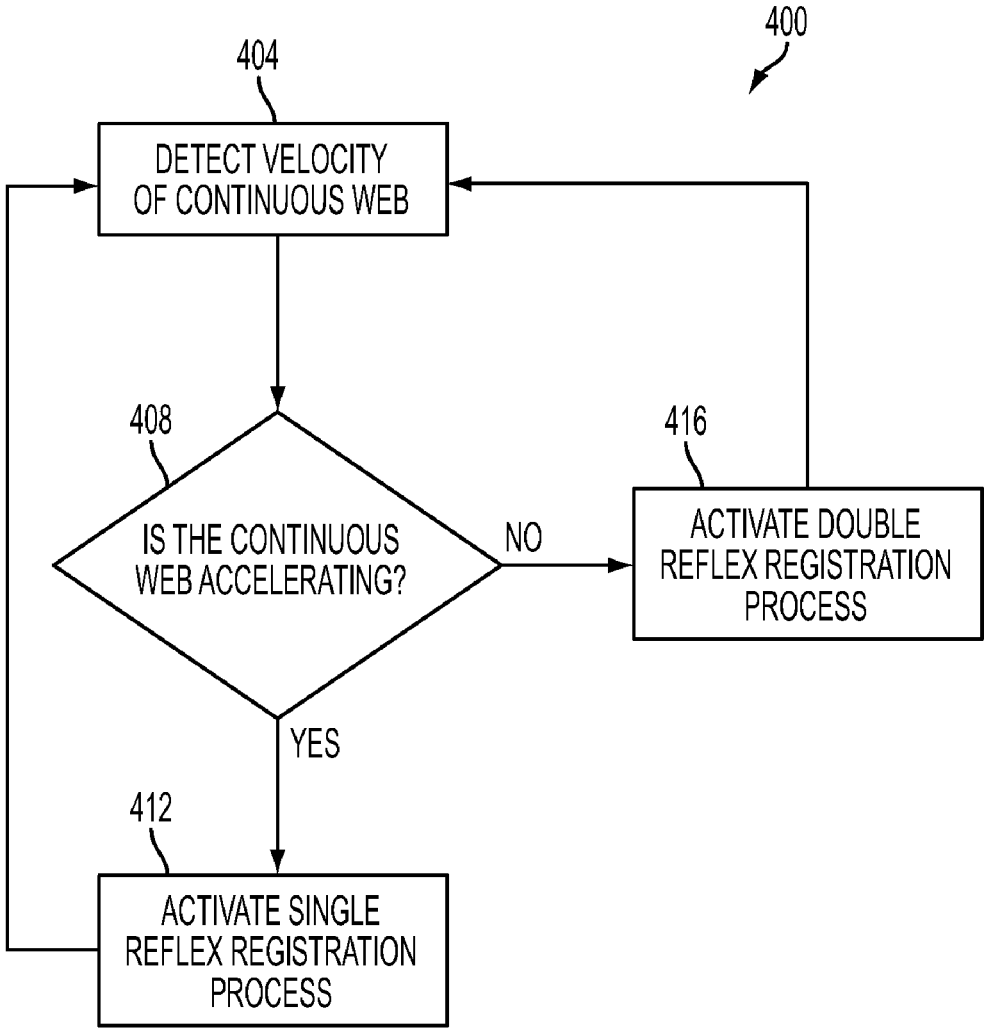
FIG. 4 is a flowchart of a process that may be implemented by a controller operating at least one marking station in accordance with a double reflex registration method and a single reflex registration method selectively.

The printing system 100 may be operated according to the process 400 illustrated by the flowchart of FIG. 4. The process 400 begins with the printing system 100 detecting a velocity of the continuous web (block 404). The velocity is detected by one or more of the encoders 116A, 116B, 116C and may be received by the controller 112 from at least one of the converters 120A, 120B, 120C or from at least one of the filters 132A, 132B, 132C, 136.

Next, the printing system 100 determines if the linear velocity of the continuous web 128 at each marking station 104A, 104B, 104C, 104D should be determined with the single reflex registration method or the double reflex registration method. The printing system 100 may determine which registration method to use in at least two ways. First, the machine controller 112 may determine if the continuous web 128 is accelerating (block 408). If a magnitude of the web acceleration is above a threshold magnitude, the controller 112 utilizes the single reflex registration process (block 412), and if the continuous web 128 is not accelerating, or if a magnitude of the acceleration is below an acceleration threshold, the controller utilizes the double reflex registration process (block 416). Second, the machine controller 112 may compare a velocity measurement to a threshold velocity. If the velocity measurement is below the threshold velocity, the controller 112 utilizes the single reflex registration process (block 412), and if the velocity measurement is above the threshold velocity, the controller utilizes the double reflex registration process (block 416).

The controller 112 may utilize a weighted sum of the linear velocities calculated with both the single and double reflex registration methods if the controller 112 determines that the registration method should be switched during operation of the printing system 100. For example, if while operating in double reflex registration mode the controller 112 detects that the continuous web 128 is accelerating or that the velocity of the continuous web has fallen below a threshold velocity, the controller may initiate a process for switching from the double reflex registration mode to the single reflex registration mode. In particular, for a predetermined time period, the controller 112 may determine the linear velocity of the web 128 as a weighed sum of the velocities calculated by the single reflex registration method and the double reflex registration method. The controller 112 gradually phases in the velocity calculation for the single reflex mode and phases out the velocity calculation from the double reflex, such that the web velocity is determined entirely with the single reflex mode at the end of the predetermined time period. The controller 112 employs a similar routine to switch gradually from single to double reflex registration in which the velocity calculated from the single reflex registration is phased out and the velocity calculated from the double reflex registration is phased in over the course of the predetermined time period. An exemplary predetermined time period may be one millisecond.

Figure 5:
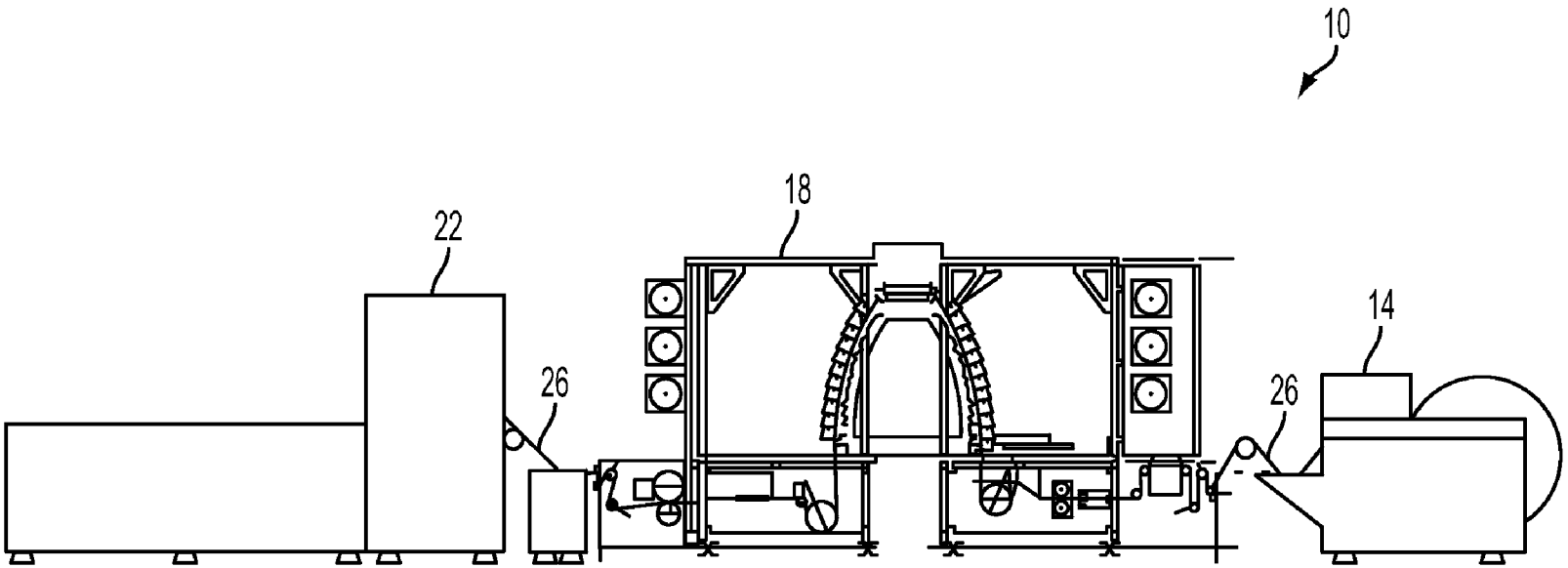
FIG. 5 is a block diagram of a known web printing system.

Accurately determining the velocity of the continuous web 128 enables peripheral devices connected to a printing system to function properly. For example, as shown in FIG. 5, a cutting station 22 may be connected to an output of a printing system 18 to receive the continuous web 26 after the marking stations print an image thereon. The velocity of the continuous web 26 determined by a controller may be electronically coupled to the cutting station 22, such that the cutting station may accurately cut the continuous web into predetermined lengths when the continuous web is accelerating, decelerating, and moving a constant speed. Alternatively, the cutting station 22 may determine when to cut the web 26 in response to sensing fiduciary markers or test patterns printed upon the continuous web, as is known to those of ordinary skill in the art.

The printing system 100 prints images on the continuous web 128 with one of numerous ink compositions. Exemplary ink compositions include, but are not limited to, phase change inks, gel based inks, curable inks, aqueous inks, and solvent inks. As used herein, the term "ink composition" encompasses all colors of a particular ink composition including, but not limited to, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink", also referred to as "solid ink", encompasses inks that remain in a solid phase at an ambient temperature and that melt to a liquid phase when heated above a threshold temperature, referred to in some instances as a melt temperature. The ambient temperature is the temperature of the air surrounding the printing system 100; however, the ambient temperature may be a room temperature when the printing system is positioned in an enclosed or otherwise defined space. An exemplary range of melt temperatures for phase change ink is approximately seventy degrees (70° to one hundred forty degrees (140°) Celsius; however, the melt temperature of some phase change inks may be above or below the exemplary melt temperature range. When phase change ink cools below the melt temperature the ink returns to the solid phase. The marking stations eject phase change ink in the liquid phase onto the continuous web 128 and the ink becomes affixed to the web in response to the ink cooling below the melt temperature.

The terms "gel ink" and "gel based ink", as used herein, encompass inks that remain in a gelatinous state at the ambient temperature and that may be heated or otherwise altered to have a different viscosity suitable for ejection onto the continuous web 128 by the marking stations 104A, 104B, 104C, 104D. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty degrees (30°) to fifty (50°) degrees Celsius; however, the gelation temperature of some gel inks may be above or below the exemplary gelation temperature range. The viscosity of gel ink increases when the ink cools below the gelation temperature. Some gel inks ejected onto the continuous web 128 become affixed to the web in response to the ink cooling below the gelation temperature.

Some ink compositions, referred to herein as curable inks, are cured by the printing system 100. As used herein, the process of "curing" ink refers to curable compounds in an ink undergoing an increase in molecular weight in response to being exposed to radiation. Exemplary processes for increasing the molecular weight of a curable compound include, but are not limited to, crosslinking and chain lengthening. Cured ink is suitable for document distribution, is resistant to smudging, and may be handled by a user. Radiation suitable to cure ink may encompass the full frequency (or wavelength)

spectrum including, but not limited to, microwaves, infrared, visible, ultraviolet, and x-rays. In particular, ultraviolet-curable gel ink, referred to herein as UV gel ink, becomes cured after being exposed to ultraviolet radiation. As used herein, the term "ultraviolet" radiation encompasses radiation having a wavelength from approximately fifty nanometers (50 nm) to approximately five hundred nanometers (500 nm).

In response to being configured to print curable ink, the printing system 100 includes a leveling device 160 and a curing assembly 164. The ink leveling device 160 is configured to spread ink droplets ejected onto the continuous web 128 into a substantially continuous area without physically contacting the ink droplets. When ink droplets contact the continuous web 128 there may be a space between each ink droplet and a plurality of surrounding ink droplets. The ink leveling 160 device flattens the ink droplets such that each ink droplet contacts one or more adjacent ink droplets to form a continuous area of ink. The ink leveling device 160 is commonly used to spread gel ink; however, the ink leveling device is not limited to spreading only gel ink. The ink leveling device 160 may expose the ink to infrared radiation to spread the ink without contacting the ink.

The curing assembly 164 may be mounted to the printer frame subsequent to the marking stations 104A, 104B, 104C, 104D and the leveling device 160 to cure the ink ejected onto the continuous web 128. The curing assembly 164 is positioned along the web path to cure the ink ejected onto the continuous web 128 before the ejected ink contacts any of a series of rollers (for example, the roller 108C), which guide the web along the web path. The curing assembly 164 may expose the ink to ultraviolet radiation to cure the ink.

The printing system 100 has been described as a simplex printing system in which an image is formed on only one side of the continuous web 128. The printing system 100, however, may also be a duplex printing system in which an image is formed on both sides of the continuous web 128, with the addition of a web inverter as known to those of ordinary skill in the art.

Those of ordinary skill in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing system comprising:

at least one marking station arranged along a portion of a web path;

a first roller in the web path, the first roller being configured to move a web of media along the portion of the web path along which the at least one marking station is arranged;

a second roller in the web path, the second roller being configured to move the web of media along the portion of the web path along which the at least one marking station is arranged;

a first encoder mounted proximate the first roller and configured to generate an angular velocity signal corresponding to rotation of the first roller;

a second encoder mounted proximate the second roller and configured to generate an angular velocity signal corresponding to rotation of the second roller;

a first converter operatively connected to the first encoder and configured to generate a first linear velocity signal corresponding to a velocity for a web moving along the web path at the first roller;

a second converter operatively connected to the second encoder and configured to generate a second linear velocity signal corresponding to a velocity for a web moving along the web path at the second roller;

a low pass filter operatively connected to the first converter to identify a low frequency component of the first linear velocity;

a high pass filter operatively connected to the first converter to identify a high frequency component of the first linear velocity;

a high pass filter operatively connected to the second converter to identify a high frequency component of the second linear velocity;

a first adder configured to compute a first filtered linear velocity at the first roller with reference to the high frequency component of the first linear velocity and the low frequency component of the first linear velocity;

a second adder configured to compute a second filtered linear velocity at the second roller with reference to the low frequency component of the first linear velocity and the high frequency component of the second linear velocity; and a controller operatively connected to the at least one marking station, the first adder, the second adder, the first converter, and the second converter to operate the at least one marking station with reference to a registration control mode, the controller being configured to compute a linear velocity for the web with reference to the linear velocity signal generated by only one of the first converter and the second converter in response to a first registration control mode being active and to compute the linear velocity of the web with reference to the first filtered linear velocity and the second filtered linear velocity in response to a second registration control mode being active.

2. The system of claim 1, the controller being further configured to operate the at least one marking station with reference to a weighted sum of the linear velocity computed with reference to only the linear velocity generated by only one of the first converter and the second converter and the linear velocity computed with the first filtered linear velocity and the second filtered linear velocity.

3. The system of claim 1 wherein the first registration control mode is activated in response to the computed linear velocity being less than a first predetermined threshold; and the second registration control mode is activated in response to the computed linear velocity being equal to or exceeding the first predetermined threshold.

4. The system of claim 3, the controller being further configured to weight the linear velocities of the sum with reference to a difference between one of the linear velocities in the sum and a velocity set point.

5. The system of claim 1, the controller being further configured to compute a linear acceleration for the web with reference to the linear velocity computed with reference to only the linear velocity generated by only one of the first converter and the second converter.

6. The system of claim 5, the controller being further configured to (i) activate the first registration control mode in response to a magnitude of the linear acceleration for the web being greater than a first predetermined threshold and (ii) to activate the second registration control mode in response to a magnitude of the linear acceleration for the web being less than the first predetermined threshold.

7. The system of claim 1, wherein the first roller is positioned before the at least one marking station in a direction of a web motion and the second roller is positioned after the at least one marking station in the direction of web motion.

* * * * *